US006038975A

United States Patent [19]

Hoffmann et al.

[11] Patent Number: 6,038,975

[45] **Date of Patent: *Mar. 21, 2000**

[54] PRINTING ROLLER FOR CHANNEL-FREE PRINTING

[75] Inventors: Eduard Hoffmann, Bobingen; Wolfgang Prem, Kutzenhausen, both of Germany

[73] Assignee: MAN Roland Druckmaschinen AG, Offenbach am Main, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/886,231

[22] Filed: Jul. 1, 1997

Related U.S. Application Data

[63] Continuation of application No. 08/526,924, Sep. 12, 1995, abandoned.

[30] Foreign Application Priority Data

Sep. 15, 1994 [DE] Germany ..... P 44 32 816

[51] Int. Cl.[7] ..... B41F 13/10

[52] U.S. Cl. ..... 101/375; 492/30

[58] Field of Search ..... 101/375, 376, 101/378, 382.1, 479, 415.1; 492/28, 30, 40

[56] References Cited

U.S. PATENT DOCUMENTS

| | | | |
|---|---|---|---|
| 2,450,727 | 10/1948 | Haushalter | 101/375 |
| 3,096,949 | 7/1963 | Hoffman . | |
| 4,089,265 | 5/1978 | White et al. | 101/375 |
| 4,656,942 | 4/1987 | Vertegaal et al. | 101/375 |
| 4,685,393 | 8/1987 | Saueressig . | |
| 4,794,858 | 1/1989 | Katz | 101/375 |
| 4,903,597 | 2/1990 | Hoage et al. | 101/375 |
| 5,168,808 | 12/1992 | Prem | 101/375 |
| 5,216,954 | 6/1993 | Thompson | 101/375 |
| 5,468,568 | 11/1995 | Kuhn et al. | 101/389.1 |
| 5,481,975 | 1/1996 | Schulz | 101/375 |

FOREIGN PATENT DOCUMENTS

| | | | |
|---|---|---|---|
| 0196443 | 10/1986 | European Pat. Off. . | |
| 0366395 | 5/1990 | European Pat. Off. . | |
| 0452184 | 10/1991 | European Pat. Off. . | |
| 25 42 748 | 4/1976 | Germany . | |
| 41 06 677 | 4/1977 | Germany . | |
| 57107842 | 7/1982 | Japan . | |
| 2031801 | 4/1980 | United Kingdom | 101/375 |

*Primary Examiner*—Ren Yan

*Attorney, Agent, or Firm*—Cohen, Pontani, Lieberman & Pavane

[57] ABSTRACT

A printing roller for channel-free printing, in particular for a rotary offset printing machine including a roller core 1 on which a sleeve-shaped printing or transfer form 2 can be positioned. The roller includes a thin intermediate layer 7 provided at least partially between the outer surface of the roller core 1 and the inner surface of the sleeve-shaped printing or transfer form 2 for adjusting the printing or transfer form 2 on the printing roller 1, 3, 4, 6 and for securing the printing or transfer form 2 in an improved manner. The printing roller constructed according to the present invention allows a sleeve-shaped printing or transfer form to be adjusted or fitted precisely and in a stationary manner on the printing roller when slid onto the printing roller without limiting the principle on which the sleeve technique for printing is based.

1 Claim, 1 Drawing Sheet

10
2
5
6
7
8
9
1
3
4

PRINTING ROLLER FOR CHANNEL-FREE PRINTING

This is a continuation of application Ser. No. 08/526,924, filed Sep. 12, 1995, abandoned.

BACKGROUND OF THE INVENTION

1. Field of the Invention

The present invention relates to printing rollers and, more particularly, to printing rollers on which a sleeve can be precisely aligned.

2. Description of the Prior Art

In modern sleeve technology, that is, in techniques for channel-free printing—specifically with a rubber blanket and printing form—the sleeve-shaped printing form or transfer form is conventionally applied to a printing roller by expanding the printing form or transfer form using compressed air and slipping the printing form onto the printing roller. When the compressed air is removed, the printing form or transfer form contacts the printing roller in a positive engagement based on the principle of a shrinkage fit. The printing form or transfer form can be removed again from the printing roller by once again supplying compressed air. As a rule, such a printing roller is normally manufactured from a metallic work material and preferably has a chrome coating to protect it from corrosion due to commonly used media.

A printing roller of this kind is known from the German Patent Application P 43 42 159.8. This patent application describes a sleeve-shaped printing form. The sleeve, whose inner diameter is smaller than the diameter of the supporting part of the cylinder, is mechanically widened to obtain a diameter at least equal to the diameter of the supporting part of the cylinder prior to pre-centering using a conical chamfer positioned at an entry end of the printing roller body so that the sleeve can be completely slid onto the roller body. A supply of compressed air passing through outlet bores on the cylinder provide an air cushion acting to increase the diameter of the sleeve and aid in positioning the sleeve on the roller body.

Further, it is known in today's printing industry to use plastic sheets as a base for adjusting or aligning conventional rubber blankets and printing forms in plate form, as well as for lengthening and reducing the printed image. However, such plastic sheets as known in the art are not applicable for use with sleeve technology.

SUMMARY OF THE INVENTION

It is accordingly an object of the present invention to provide a printing roller of the generic type having a sleeve-shaped printing form or transfer form which can be aligned or adjusted precisely and in a stationary manner on the printing roller when this sleeve-shaped printing form or transfer form is slid onto the printing roller without limiting the principle on which sleeve technique is based.

The present invention relates to printing rollers for channel-free printing including a roller core having an outer surface. A sleeve-shaped printing form having an inner surface is positioned about the outer surface of the roller core and a thin intermediate layer is positioned at least partially between the outer surface of the roller core and the inner surface of the sleeve-shaped printing form for adjusting and securing the printing form on the printing roller.

The thin intermediate layer may be a self-adhesive plastics sheet which is positioned on the outer surface of the roller core. Alternatively, the thin intermediate layer may be a coating applied to the surface of the roller core. The coating may be, for example, plastic, lacquer, a metallic base material, or a ceramic material. The thin intermediate layer may also be an exchangeable sleeve positioned about the surface of the roller core.

The surface of the roller core may include a reduced region including a substantially cylindrical surface and a surface region also including a substantially cylindrical surface having air outlet bores opening at the outer surface of the surface region. The circumference of the reduced region is smaller than the circumference of the surface region by an amount equal to the thickness of the intermediate layer. The air outlet bores open at an elevated position on the outer surface of the roller core relative to the surface of reduced region. The printing roller may also include a notch extending around the circumference of the roller core and positioned between the reduced region and the surface region for providing a guide to cut the intermediate layer for placement on the roller core.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

Figure 1:
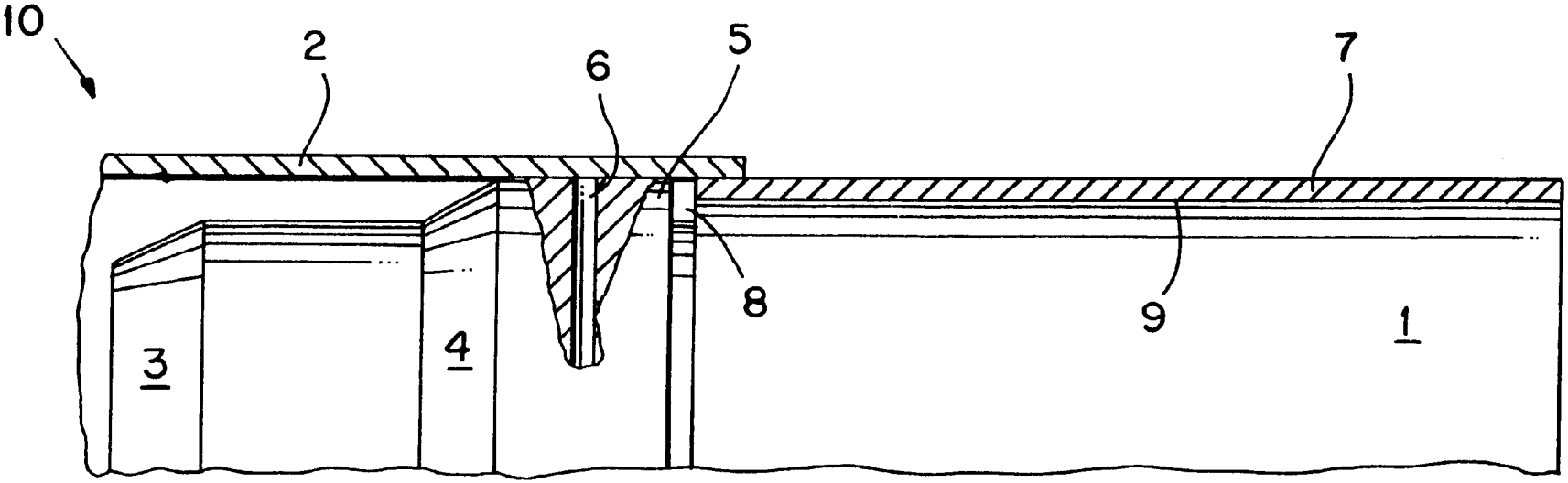
FIG. 1 shows schematic partial cross-sectional longitudinal view of a portion of a printing roller in accordance with the present invention.

FIG. 1 is a schematic view of a partial longitudinal section of a printing roller 10 with a printing or transfer form 2 partially slid onto its roller core 1.

The roller core 1 is normally constructed as a hollow body having a greater wall thickness than the sleeve-shaped printing or transfer form 2 and is constructed to have cylinder diameter which is larger than the relaxed inner diameter of the printing or transfer form 2.

In order to facilitate the application of the printing or transfer form 2, a cylindrical piece in the form of a pre-centering cone 3 having a smaller diameter than the relaxed inner diameter of the printing or transfer form 2 is provided at one end face of the printing roller 10, and the printing or transfer form 2 can be roughly positioned on the printing roller 10 via this pre-centering cone 3.

When pushed farther onto a conical slip-on cone 4 of the printing roller 10 positioned between the pre-centering cone 3 and the roller core 1, the printing form 2 is expanded to a diameter corresponding to the diameter of the surface region 5 of the roller core 1, into which air outlet bores 6 open. When passing the air outlet bores 6, the printing form 2 is elastically expanded by the air exiting through the outlet bores 6 and is able to slide on a compressed-air cushion into its final position on the roller core 1 of the printing roller 10.

A thin intermediate layer 7 is provided between the surface of the roller core 1 and the inner surface of the sleeve-shaped printing form 2 for adjusting the printing form 2 and improving its anchoring on the printing roller 10.

In order to aid in adjusting and anchoring the printing form 2 on the surface of the roller core 1 a stepped or reduced region 9 is provided so that the surface region 5 of the roller core 1 in which the air outlet bores 6 open are elevated relative to the reduced region 9. The reduced region has a diameter which is reduced in size from the diameter of the surface region by an amount corresponding to the thickness of the intermediate layer 7.

The reduced region 9 of the roller core 1 is coated on all sides with the thin intermediate layer 7 in such a way that the surface region 5 with the air outlet bores 6 and the reduced surface region 9 of the roller core 1 extend flush with the intermediate coating layer 7. Both end faces of the a printing roller 10 can be of identical construction.

In the present example, the thin intermediate layer 7 is preferably a self-adhesive plastic sheet which can be easily exchanged or replaced. In order to cut the sheet precisely to the dimensions of the roller core 1, a notch 8 extending around the circumference of the roller core 1 is provided between the reduced region 9 and the elevated region 5 for guiding a cutting tool.

As an alternative to the self-adhesive plastic sheet, the thin intermediate layer 7 can also be a coating applied to the entire surface of the roller and preferably to the reduced surface region 9 of the roller core 1. The coating may be formed of a plastic, lacquer, metallic base material or ceramic material or any other material which accomplishes the above discussed purposes of the intermediate layer.

It is also possible to glue the plastic sheet to the entire surface of the roller core 1 which, in this case, will not have any reduced surface region. The sheet must then be cut in the area of the air outlet bores 6 allowing the compressed air to reach the outer surface of the sheet and printing roller and provide the air cushion for expanding the diameter of the printing form 2 during placement on or removal from the roller 10.

Similarly, the thin intermediate layer 7 itself can, of course, also be constructed as an exchangeable sleeve.

Accordingly, it is possible, on the one hand, to align sleeve-shaped printing cylinders in the form of rubber blankets or printing forms on a printing roller constructed in this way as in conventional offset printing in which the rubber blankets and printing forms are not in the form of sleeves and, on the other hand, to provide optimal adhesion on the roller core.

The invention is not limited by the embodiments described above which are presented as examples only but can be modified in various ways within the scope of protection defined by the appended patent claims.

We claim:

1. A printing roller for channel-free printing, comprising:

a roller core (1) including an outer surface;

a sleeve-shaped printing form (2) including an inner surface position about said outer surface of said roller core;

a thin intermediate layer (7) having a thickness and positioned at least partially between said outer surface of said roller core (1) and said inner surface of said sleeve-shaped printing form (2) for adjusting and securing the printing form (2) on the printing roller, said outer surface of said roller core (1) including a reduced region (9) including a substantially cylindrical surface having a circumference, and a surface region (5) including a substantially cylindrical surface having a circumference and air outlet bores (6) opening at said surface of said surface region, said circumference of said reduced region being smaller than said circumference of said surface region by an amount equal to said thickness of said intermediate layer and said air outlet bores opening at said surface of said surface region in an elevated position relative to said surface of said reduced region (9); and a notch (8) extending around the outer surface of the roller core (1) at a position between said reduced region (9) and said surface region (5) for providing a guide to cut said intermediate layer.

* * * * *